US007851222B2

(12) United States Patent
Hoermann et al.

(10) Patent No.: US 7,851,222 B2
(45) Date of Patent: Dec. 14, 2010

(54) SYSTEM AND METHODS FOR MEASURING CHEMICAL CONCENTRATIONS OF A PLATING SOLUTION

(75) Inventors: Alexander F. Hoermann, Menlo Park, CA (US); Yevgeniy Rabinovich, Fremont, CA (US); Kathryn P. Ta, Saratoga, CA (US)

(73) Assignee: Applied Materials, Inc., Santa Clara, CA (US)

( * ) Notice: Subject to any disclaimer, the term of this patent is extended or adjusted under 35 U.S.C. 154(b) by 1446 days.

(21) Appl. No.: 11/189,368

(22) Filed: Jul. 26, 2005

(65) Prior Publication Data

US 2007/0026529 A1 Feb. 1, 2007

(51) Int. Cl.
*G01N 35/08* (2006.01)

(52) U.S. Cl. ..... 436/53; 436/180; 204/198; 204/240; 422/99; 422/100

(58) Field of Classification Search ..... 436/53, 436/180; 204/195, 198, 240; 422/99–100
See application file for complete search history.

(56) References Cited

U.S. PATENT DOCUMENTS 3,229,198 A * 1/1966 Libby ..... 324/233
3,602,033 A 8/1971 Burrell et al.
3,649,509 A 3/1972 Morawetz et al.
3,887,110 A 6/1975 Porter
4,045,304 A 8/1977 Tezuka
4,055,751 A 10/1977 Bussman et al.
4,102,756 A 7/1978 Castellani et al.
4,102,770 A 7/1978 Moriarty et al.
4,110,176 A 8/1978 Creutz et al.
4,132,605 A 1/1979 Tench et al.
4,252,027 A 2/1981 Ogden et al.
4,276,323 A 6/1981 Oka et al.
4,286,965 A 9/1981 Vanhumbeeck et al.
4,314,823 A 2/1982 Rich, Jr. et al.
4,315,059 A 2/1982 Raistrick et al.
4,321,322 A 3/1982 Ahnell (Continued)

FOREIGN PATENT DOCUMENTS

DE 4405741 1/1995

(Continued)

OTHER PUBLICATIONS

Elsevier B.V. "Study of the zinc electroplating process using electrochemical noise technique" Journal of ectroanalytical Chemistry, Feb. 25, 2005.*

(Continued)

*Primary Examiner*—Jyoti Nagpaul
(74) *Attorney, Agent, or Firm*—Patterson & Sheridan, LLP

(57) ABSTRACT

An electrochemical plating system, which includes one or more plating cell reservoirs for storing plating solution and a chemical analyzer in fluidic communication with the one or more plating cell reservoirs. The chemical analyzer is configured to measure chemical concentrations of the plating solution. The plating system further includes a plumbing system configured to facilitate the fluidic communication between the one or more plating cell reservoirs and the chemical analyzer and to substantially isolate the chemical analyzer from electrical noise generated by one or more plating cells of the one or more plating cell reservoirs.

13 Claims, 5 Drawing Sheets

U.S. PATENT DOCUMENTS 4,326,940 A 4/1982 Eckles et al.
4,336,114 A 6/1982 Mayer et al.
4,364,263 A 12/1982 Sankoorikal et al.
4,376,569 A 3/1983 Barltrop et al.
4,376,685 A 3/1983 Watson
4,405,416 A 9/1983 Raistrick et al.
4,435,266 A 3/1984 Johnston
4,468,331 A 8/1984 Antle et al.
4,469,564 A 9/1984 Okinaka et al.
RE31,694 E 10/1984 Slominski et al.
4,479,852 A 10/1984 Bindra et al.
4,514,265 A 4/1985 Rao et al.
4,528,158 A 7/1985 Gilles et al.
4,595,462 A 6/1986 Vangaever et al.
4,628,726 A 12/1986 Heikkila et al.
4,631,116 A 12/1986 Ludwig
4,692,346 A 9/1987 McBride et al.
4,694,682 A 9/1987 Heikkila et al.
4,725,339 A 2/1988 Bindra et al.
4,750,977 A 6/1988 Marrese
4,774,101 A 9/1988 Harris et al.
4,789,445 A 12/1988 Goffman et al.
4,889,611 A * 12/1989 Blough, Jr. ..... 204/411
4,932,518 A 6/1990 Bernards et al.
5,039,381 A 8/1991 Mullarkey
5,055,425 A 10/1991 Leibovitz et al.
5,092,975 A 3/1992 Yamamura et al.
5,119,020 A * 6/1992 Massey et al. ..... 324/754
5,162,260 A 11/1992 Leibovitz et al.
5,182,131 A 1/1993 Hashimoto et al.
5,192,403 A 3/1993 Chang et al.
5,196,096 A 3/1993 Chang et al.
5,222,310 A 6/1993 Thompson et al.
5,223,118 A 6/1993 Sonnenberg et al.
5,224,504 A 7/1993 Thompson et al.
5,230,743 A 7/1993 Thompson et al.
5,244,811 A 9/1993 Matthews
5,256,274 A 10/1993 Poris
5,298,129 A 3/1994 Eliash
5,298,132 A 3/1994 Reddy et al.
5,316,974 A 5/1994 Crank
5,320,724 A 6/1994 Ludwig et al.
5,328,589 A 7/1994 Martin
5,342,527 A 8/1994 Chevallet et al.
5,352,350 A 10/1994 Andricacos et al.
5,364,510 A 11/1994 Caprio
5,368,711 A 11/1994 Poris
5,368,715 A 11/1994 Hurley et al.
5,377,708 A 1/1995 Bergman et al.
5,378,628 A 1/1995 Gratzel et al.
5,389,215 A 2/1995 Horiuchi et al.
5,389,546 A 2/1995 Becket
5,391,271 A 2/1995 Ludwig
5,429,733 A 7/1995 Ishida
5,447,615 A 9/1995 Ishida
5,450,870 A 9/1995 Suga et al.
5,484,626 A 1/1996 Storjohann et al.
5,510,018 A 4/1996 Rey
5,516,412 A 5/1996 Andricacos et al.
5,631,845 A 5/1997 Filev et al.
5,635,043 A 6/1997 Tur'yan et al.
5,705,223 A 1/1998 Bunkofske
5,723,028 A 3/1998 Poris
5,750,014 A 5/1998 Stadler et al.
5,755,954 A 5/1998 Ludwig et al.
5,908,540 A 6/1999 Fanti
5,908,556 A 6/1999 Cavotta et al.
5,932,791 A 8/1999 Hambitzer et al.
5,972,192 A 10/1999 Dublin et al.
5,976,341 A 11/1999 Schmacher et al.
6,017,427 A 1/2000 Yamamoto
6,024,856 A 2/2000 Haydu et al.
6,024,857 A 2/2000 Reid
6,113,759 A 9/2000 Uzoh
6,113,771 A 9/2000 Landau et al.
6,140,241 A 10/2000 Shue et al.
6,176,992 B1 1/2001 Talich
6,224,737 B1 5/2001 Tsai et al.
6,241,953 B1 * 6/2001 Krijgsman ..... 422/208
6,254,760 B1 7/2001 Shen et al.
6,258,220 B1 * 7/2001 Dordi et al. ..... 204/198
6,280,602 B1 8/2001 Robertson
6,365,033 B1 4/2002 Graham et al.
6,391,209 B1 * 5/2002 Belongia et al. ..... 210/748
6,454,927 B1 9/2002 Stevens et al.
6,458,262 B1 10/2002 Reid
6,471,845 B1 10/2002 Dukovic et al.
6,495,453 B1 12/2002 Brongersma et al.
6,551,479 B1 4/2003 Graham et al.
6,592,736 B2 7/2003 Fulton et al.
6,596,148 B1 * 7/2003 Belongia et al. ..... 205/99
6,635,157 B2 10/2003 Dordi et al.
6,860,944 B2 * 3/2005 Ivanov et al. ..... 118/50
2002/0153254 A1 * 10/2002 Belongia et al. ..... 205/101
2002/0180609 A1 * 12/2002 Ding et al. ..... 340/633
2004/0016637 A1 1/2004 Yang et al.
2004/0206623 A1 10/2004 D'Ambra et al.
2005/0053522 A1 * 3/2005 King et al. ..... 422/68.1
2005/0077182 A1 4/2005 Balisky et al.

FOREIGN PATENT DOCUMENTS

EP 0180090 7/1986
JP 58-182823 10/1983
JP 62030898 9/1987
JP 10-121297 5/1988
JP 63-118093 5/1988
JP 4-131395 5/1992
JP 04314883 6/1992
JP 4-280993 10/1992
JP 6-017291 1/1994
WO WO 97/12079 4/1997

OTHER PUBLICATIONS

Colombo, "Wafer Back Surface Film Removal," Central R&D, SGS-Thomson Microelectronics, Agrate, Italy.
Singer, "Wafer Processing," Semiconductor International, Jun. 1998.
Pitney, "NEY Contact Manual," Electrical Contacts for Low Energy Uses, Oct. 1974.
Tench, et al., "A New Voltammetric Stripping Method Applied to the Determination of the Brighter Concentration in Copper Pyrophosphate Plating Baths", Journal of the Electrochemical Society, vol. 125, pp. 194-198.
Tench, et al., "Cyclic Pulse Voltammetric Stripping Analysis of Acid Copper Plating Baths", Journal of Electrochemical Society, Apr. 1985, pp. 831-833.
Haak, et al., "Cyclic Voltammetric Stripping Analysis of Acid Copper Sulfate Plating Baths", Plating and Surface Finishin, Apr. 1981, pp. 52-55.
Moffatt, et al. "Superconformal Electrodiposition of Copper in 500-90 nm Features", Journal of the Electrochemical Society, 147 (12) pp. 4524-4535, 2000.
Kelly, et al., "Leveling and Microstructural Effects of Additives for Copper Electrodeposition", Journal of the Electrochemical Society, 146 (7) pp. 2540-2545, 1999.
Nangoy, et al. U.S. Appl. No. 11/064,747, filed Feb. 23, 2005, entitled Closed Loop Control on Delivery System ECP Slim Cell.
WO/99/57340 International search report 3 pages.

* cited by examiner

SYSTEM AND METHODS FOR MEASURING CHEMICAL CONCENTRATIONS OF A PLATING SOLUTION

BACKGROUND OF THE INVENTION

1. Field of the Invention

Embodiments of the present invention generally relate to electrochemical plating systems, and more particularly, to analyzing plating solution used in electrochemical plating systems.

2. Description of the Related Art

Metallization of sub-quarter micron sized features is a foundational technology for present and future generations of integrated circuit manufacturing processes. More particularly, in devices such as ultra large scale integration-type devices, i.e., devices having integrated circuits with more than a million logic gates, the multilevel interconnects that lie at the heart of these devices are generally formed by filling high aspect ratio interconnect features with a conductive material, such as copper or aluminum, for example. Conventionally, deposition techniques such as chemical vapor deposition (CVD) and physical vapor deposition (PVD) have been used to fill interconnect features. However, as interconnect sizes decrease and aspect ratios increase, efficient void-free interconnect feature fill via conventional deposition techniques becomes increasingly difficult. As a result thereof, plating techniques, such as electrochemical plating (ECP) and electroless plating, for example, have emerged as viable processes for filling sub-quarter micron sized high aspect ratio interconnect features in integrated circuit manufacturing processes.

In an ECP process, for example, sub-quarter micron sized high aspect ratio features formed into the surface of a substrate may be efficiently filled with a conductive material, such as copper, for example. ECP plating processes are generally two stage processes, wherein a seed layer is first formed over the surface and features of the substrate, and then the surface and features of the substrate are exposed to a plating solution, while an electrical bias is simultaneously applied between the substrate and an anode positioned within the plating solution. The plating solution is generally rich in ions to be plated onto the surface of the substrate, and therefore, the application of the electrical bias causes these ions to be urged out of the plating solution and to be plated onto the seed layer.

One particular plating parameter of interest is the chemical composition of the plating solution used in plating the substrate. A typical plating solution includes a mixture of different chemical solutions including de-ionized (DI) water. In order to obtain a desired plating characteristic across the surface of a substrate, the plating solution should include the proper concentrations of these chemical solutions. If the proper concentrations of these chemical solutions are not present in the plating fluid, the desired plating characteristic across the surface of the substrate may not be achieved. Therefore, it is desired to properly set and maintain the desired concentrations of the chemical solutions in the plating solution prior to and during the plating of the substrate.

One impediment to maintaining the desired concentrations of the chemical solutions in a plating solution during the plating cycle is that these concentrations are continuously changing. One reason for this is that the chemical solutions continuously dissipate, decompose, and/or combine with other chemicals during the plating cycle. Thus, the concentrations of the various chemicals in a plating solution will change with time if the plating solution is left alone. Accordingly, a typical ECP plating cell includes specialized devices to control the concentrations of the chemicals in the plating fluid during the plating cycle.

One such specialized device is a chemical analyzer, which is a device that probes the plating solution and periodically determines the concentrations of the chemicals in the plating solution. Using the information of the current concentrations of the chemicals in the plating solution, the chemical analyzer then determines the amount of chemicals that need to be added to the plating solution. The chemical analyzer may also determine the amount of plating solution that needs to be drained prior to adding the chemicals in order to achieve the desired concentrations for the chemicals in the plating solution.

A plating system that includes multiple plating cells may include multiple chemical analyzers, i.e., one for each plating cell. Each chemical analyzer for a given plating system may need to be calibrated together. Due the variability of each chemical analyzer and the temperature surrounding the chemical analyzer, it may be difficult to calibrate all of them to be the same. In addition, using one chemical analyzer for each plating cell within a plating system may be cost prohibitive.

Therefore, a need exists in the art for an improved system and methods for measuring chemical concentrations of a plating solution.

SUMMARY OF THE INVENTION

Embodiments of the invention are directed to an electrochemical plating system, which includes one or more plating cell reservoirs for storing plating solution and a chemical analyzer in fluidic communication with the one or more plating cell reservoirs. The chemical analyzer is configured to measure chemical concentrations of the plating solution. The plating system further includes a plumbing system configured to facilitate the fluidic communication between the one or more plating cell reservoirs and the chemical analyzer and to substantially isolate the chemical analyzer from electrical noise generated by one or more plating cells of the one or more plating cell reservoirs.

Embodiments of the invention are also directed to a method for measuring chemical concentrations of a plating solution. The method includes delivering a portion of the plating solution from one or more plating cell reservoirs to a sampling reservoir, circulating the portion of the plating solution through a chemical analyzer and isolating fluidic communication between the one or more plating cell reservoirs and the chemical analyzer.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Figure 1:
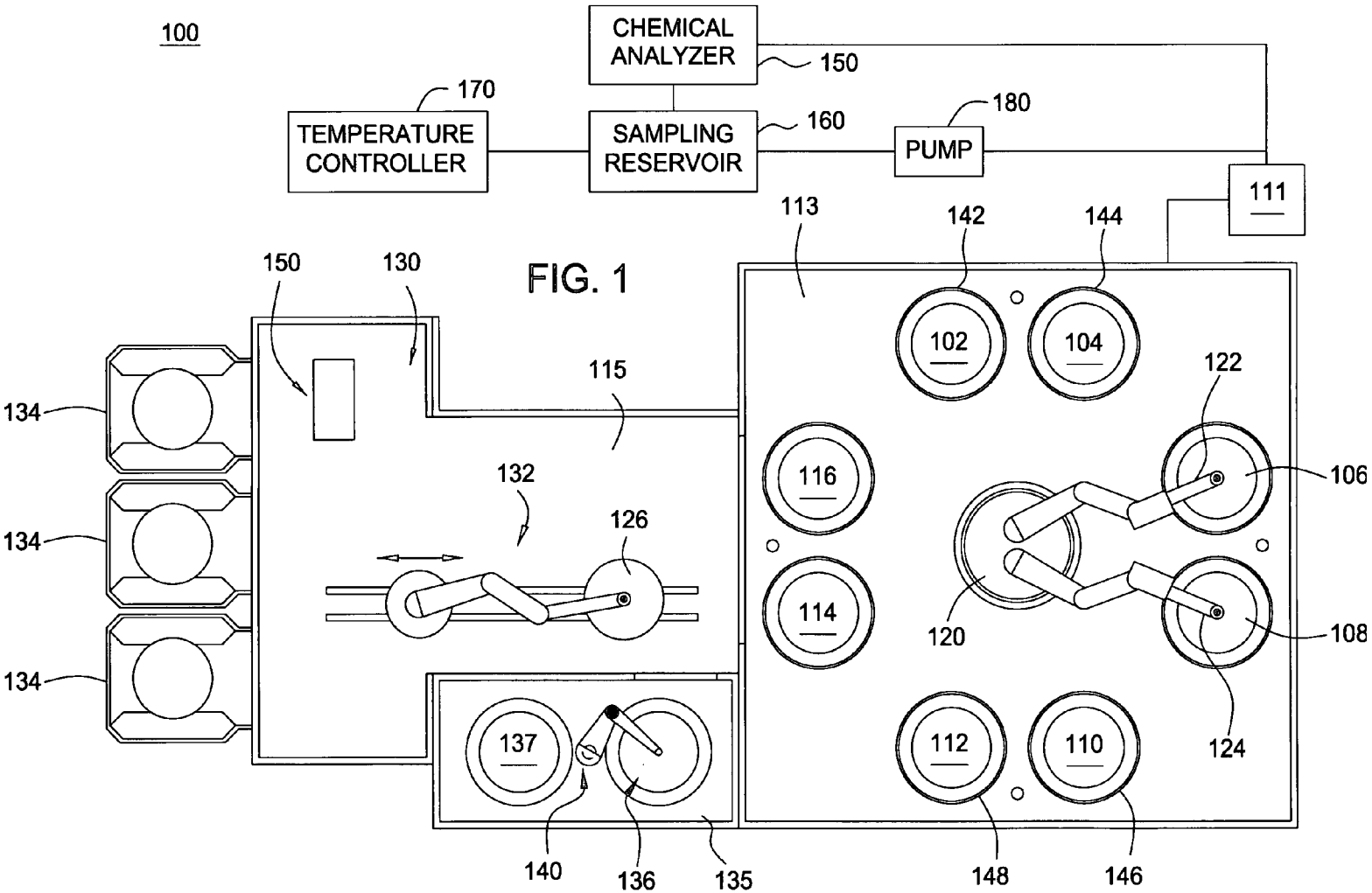
FIG. 1 illustrates a top plan view of an electrochemical plating system in accordance with one or more embodiments of the invention.

FIG. 1 illustrates a top plan view of an electrochemical plating (ECP) system 100 in accordance with one or more embodiments of the invention. The system 100 includes a factory interface (FI) 130, which may also be generally termed a substrate loading station. The factory interface 130 may include a plurality of substrate loading stations configured to interface with substrate containing cassettes 134. A robot 132 may be positioned in the factory interface 130 and may be configured to access substrates contained in the cassettes 134. Further, the robot 132 may also extend into a link tunnel 115 that connects the factory interface 130 to a processing mainframe or platform 113. The position of the robot 132 allows the robot to access the substrate cassettes 134 to retrieve substrates therefrom and then deliver the substrates to one of the processing cells 114, 116 positioned on the mainframe 113, or alternatively, to the annealing station 135. Similarly, the robot 132 may be used to retrieve substrates from the processing cells 114, 116 or the annealing station 135 after a substrate processing sequence is complete. The robot 132 may then deliver the substrate back to one of the cassettes 134 for removal from system 100.

The system 100 may further include an anneal station 135, which may include a cooling plate/position 136, a heating plate/position 137 and a substrate transfer robot 140 positioned between the two plates 136, 137. The transfer robot 140 may be configured to move substrates between the respective heating 137 and cooling plates 136.

As mentioned above, the system 100 may also include a processing mainframe 113 having a substrate transfer robot 120 centrally positioned thereon. The transfer robot 120 generally includes one or more arms/blades 122, 124 configured to support and transfer substrates thereon. Additionally, the transfer robot 120 and the accompanying blades 122, 124 are generally configured to extend, rotate, and vertically move so that the transfer robot 120 may insert and remove substrates to and from a plurality of processing locations 102, 104, 106, 108, 110, 112, 114, 116 positioned on the mainframe 113. Processing locations 102, 104, 106, 108, 110, 112, 114, 116 may be any number of processing cells utilized in an electrochemical plating platform. More particularly, the processing locations may be configured as electrochemical plating cells, rinsing cells, bevel clean cells, spin rinse dry cells, substrate surface cleaning cells (which collectively includes cleaning, rinsing, and etching cells), electroless plating cells, metrology inspection stations, and/or other processing cells that may be beneficially used in a plating platform. Each of the respective processing cells and robots are generally in communication with a system controller 111, which may be a microprocessor-based control system configured to receive inputs from both a user and/or various sensors positioned on the system 100 and appropriately control the operation of system 100 in accordance with the inputs.

Processing locations 114 and 116 may be configured as an interface between the wet processing stations on the mainframe 113 and the dry processing regions in the link tunnel 115, annealing station 135, and the factory interface 130. The processing cells located at the interface locations may be spin rinse dry cells and/or substrate cleaning cells. More particularly, each of locations 114 and 116 may include both a spin rinse dry cell and a substrate cleaning cell in a stacked configuration. Locations 102, 104, 110, and 112 may be configured as plating cells, either electrochemical plating cells or electroless plating cells, for example. Accordingly, plating cells 102, 104, 110, and 112 may be in fluid communication with plating cell reservoirs 142, 144, 146 and 148, respectively. Each plating cell reservoir is configured to maintain a large volume of plating solution, e.g., about 20 liters. Locations 106, 108 may be configured as substrate bevel cleaning cells. Additional details of the various components of the ECP system 100 are described in commonly assigned U.S. patent application Ser. No. 10/616,284 filed on Jul. 8, 2003 entitled MULTI-CHEMISTRY PLATING SYSTEM, which is incorporated herein by reference in its entirety. In one embodiment, the ECP system 100 may be a SlimCell plating system, available from Applied Materials, Inc. of Santa Clara, Calif.

The system 100 may further include a chemical analyzer 150. In one embodiment, the chemical analyzer is a real time analyzer (RTA), available from Technic, Inc. of Cranston, R.I. The chemical analyzer 150 is configured to probe a sampling of plating solution and measure chemical concentrations in the sampling of plating solution. The measurement technique may be based on AC and DC voltammetry. A voltage may be applied to metal electrodes immersed in a plating bath solution. The applied voltage causes a current to flow as it would during electroplating. The current response may be quantitatively correlated to the various chemical concentrations. The chemical analyzer 150 may include a controller for controlling the operation of the chemical analyzer 150, and the controller for the chemical analyzer 150 may be in communication with the system controller 111, which may determine the particular plating cell reservoir that is to be measured.

The chemical analyzer 150 may be coupled to a sampling reservoir 160 configured to hold a sampling of plating solution from one of the processing cells on the mainframe 113. In one embodiment, the sampling reservoir 160 is configured to hold about 300 mL to about 600 mL of liquid. The sampling reservoir 160 may be coupled to a temperature controller 170 configured to maintain or control the temperature of the liquid, e.g., plating solution, inside the sampling reservoir 160. The temperature controller 170 may include a heat exchanger or a chiller. In one embodiment, the temperature controller 170 is configured to maintain the temperature of the liquid inside the sampling reservoir 160 within a predetermined range, such as from about 18 degrees Celsius to about 22 degrees Celsius. In another embodiment, the temperature controller 170 is configured to maintain the liquid inside the sampling reservoir 160 at about 20 degrees Celsius. Further, the temperature controller 170 may be in communication with the system controller 111 to control the operation of the temperature controller 170.

The system 100 may further include a pump 180 configured to move liquid, e.g., plating solution, from a processing cell reservoir to the sampling reservoir 160 and vice versa. The pump 180 may be in communication with the system controller 111 to control the operation of the pump 180. Details of the manner in which liquid is delivered between the processing cells and the chemical analyzer are provided below with reference to FIGS. 2-5.

Figure 2:
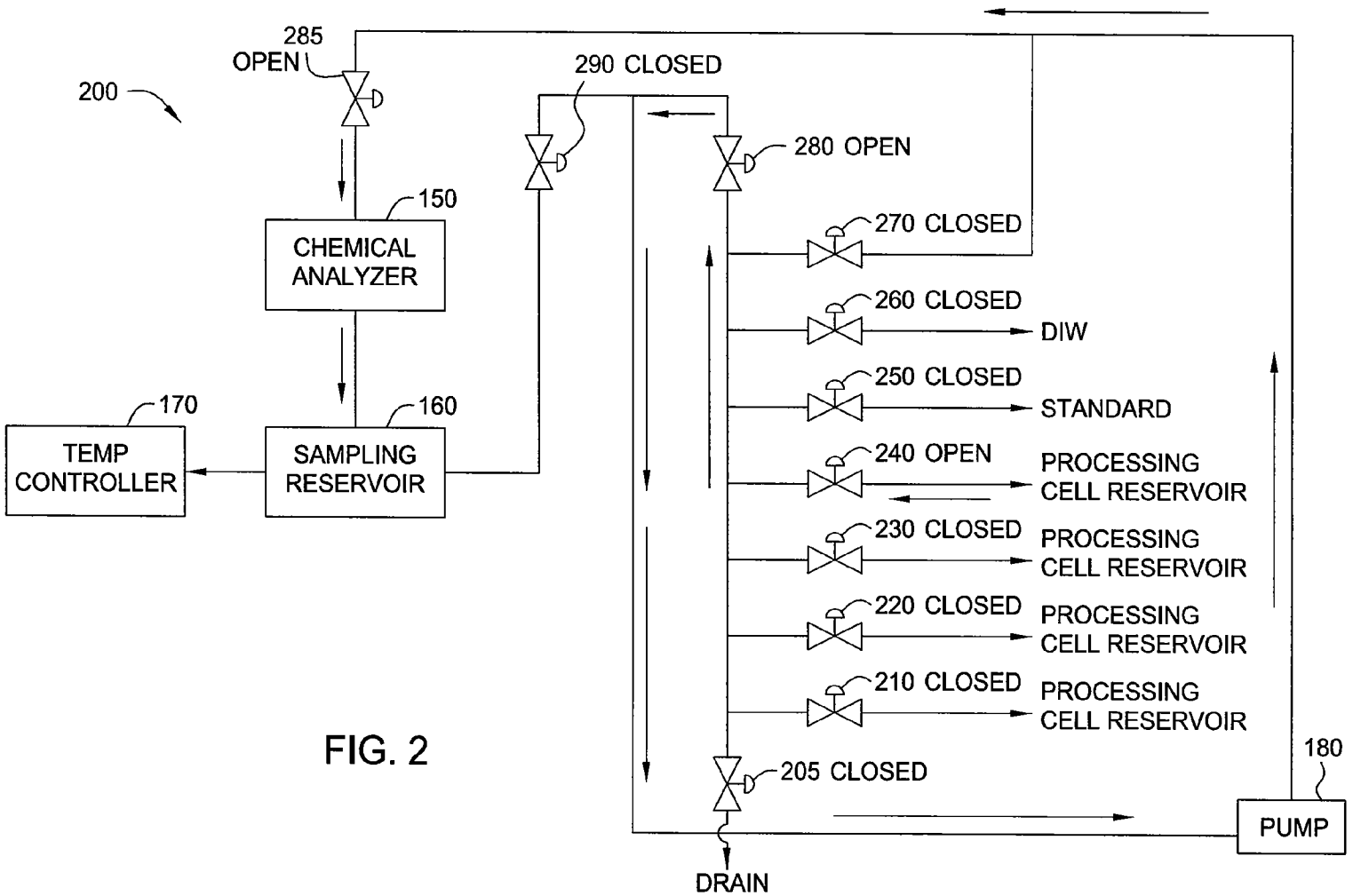
FIG. 2 illustrates a schematic diagram of a plumbing system for delivering liquid, e.g., plating solution, from the plating cells to the chemical analyzer and vice versa in accordance with one or more embodiments of the invention.

FIG. 2 illustrates a schematic diagram of a plumbing system 200 for delivering liquid, e.g., plating solution, from the plating cells to the chemical analyzer 150 and vice versa in accordance with one or more embodiments of the invention. The plumbing system 200 includes valves 210, 220, 230 and 240 for allowing liquid to flow from the respective plating cell reservoirs to the sampling reservoir 160 and vice versa. Although only four valves for plating cell reservoirs are shown, the plumbing system 200 may include any number of valves for their respective plating cell reservoirs. Each valve may be a pneumatic two-way valve. However, other types of valves commonly known by persons of ordinary skill in the art may also be used in connection with embodiments of the invention. Valve 205 is configured to allow liquid to drain out of the plumbing system 200 in an open position. Valve 250 is configured to allow calibration or standard solution to flow into the sampling reservoir 160 during calibration in an open position. Valve 260 is configured to allow de-ionized water (DIW) to flow into the sampling reservoir 160 in an open position. Valve 270 in an open position is configured to allow liquid to flow back to the plating cell reservoir during a return step, which will be described in more detail below. Valve 280 in an open position is configured to allow plating solution from a plating cell reservoir, de-ionized water or standard solution to flow to the pump 180 during a filling step, which will be described in more detail below. Valve 285 is configured to allow liquid to flow from the pump 180 to the chemical analyzer 150 in an open position. Valve 290 is configured to allow liquid to flow from the sampling reservoir 160 to the pump 180 in an open position.

FIG. 2 illustrates the flow of liquid, e.g., plating solution, from a plating cell reservoir to the sampling reservoir 160 during a filling step, which is typically one or the first steps performed prior to measuring the chemical concentrations in the plating solution. Illustratively, the filling step starts by flowing the plating solution from a processing cell reservoir through open valve 240. The plating solution then flows through open valve 280 to the pump 180. The plating solution continues to flow out of the pump 180 through open valve 285 and the chemical analyzer 150 to the sampling reservoir 160. Valves 205, 210, 220, 230, 250, 260, 270 and 290 are closed.

In one embodiment, once the sampling reservoir 160 has been filled with the plating solution and is ready to be measured by the chemical analyzer 150, valve 240 and valve 280 may be closed. In this manner, the chemical analyzer 150 may substantially be isolated from any electrical noise generated by the voltage applied to the surrounding plating cells, including the plating cell from which the plating solution comes.

As the plating solution is delivered from the plating cell reservoir to the sampling reservoir 160, the temperature of the plating solution may be increased by the temperature of the pump 180 and/or outside temperature. Thus, once the sampling reservoir 160 is filled with the plating solution, the temperature of the plating solution inside the sampling reservoir 160 may be cooled by the temperature controller 170. In one embodiment, once the temperature of the plating solution reaches a predetermined range, e.g., between about 18 degrees Celsius to about 22 degrees Celsius, the plating solution is recirculated through the chemical analyzer 150, which then measures the chemical concentrations of the plating solution inside the sampling reservoir 160. In another embodiment, the temperature of the plating solution inside the sampling reservoir 160 may be cooled to about 20 degrees Celsius. In this manner, measurements of chemical concentrations of plating solution from the various plating cell reservoirs may be performed in a more consistent and accurate manner.

Figure 3:
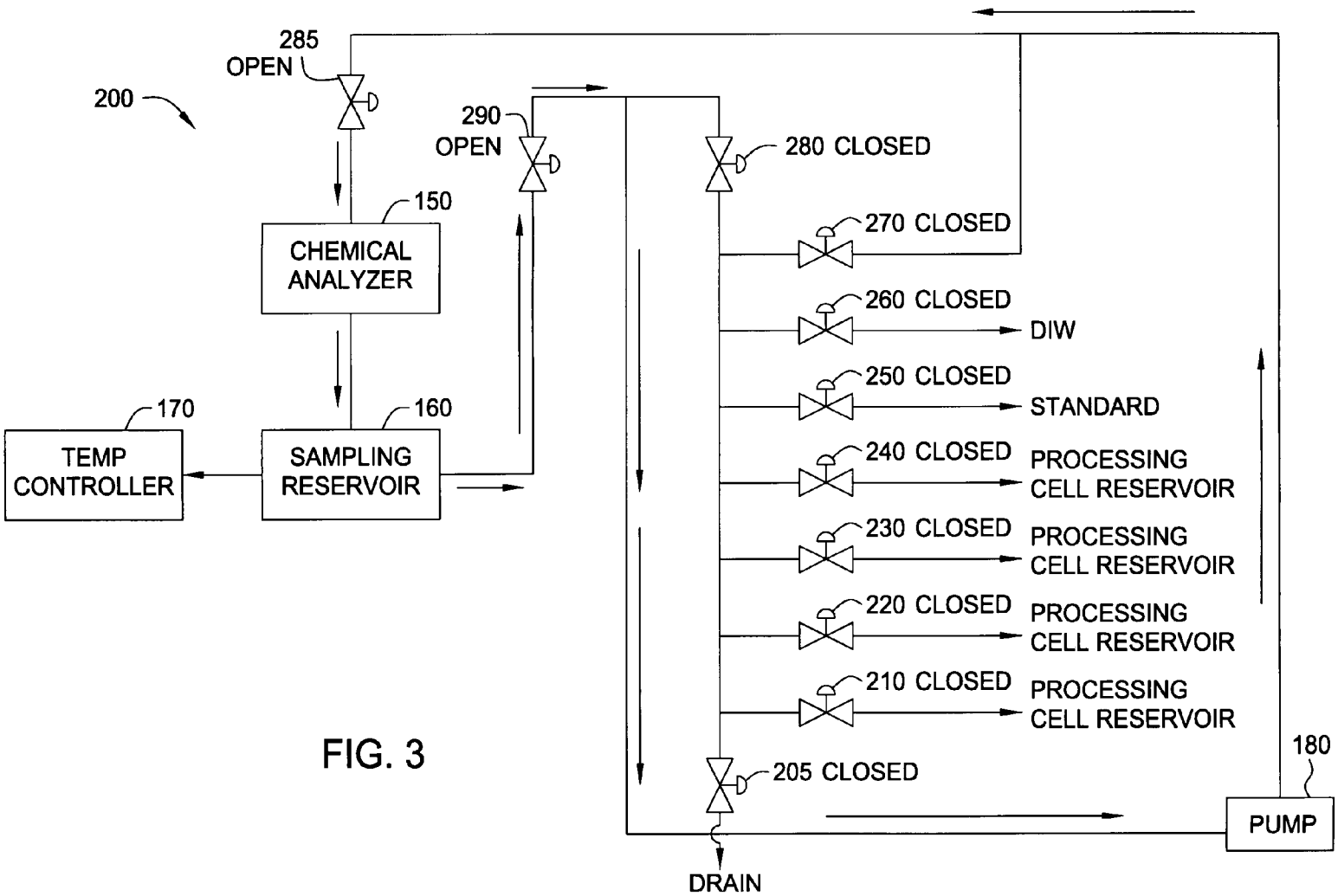
FIG. 3 illustrates a schematic diagram of the manner in which liquid, e.g., plating solution, may be delivered during the recirculation step in accordance with one or more embodiments of the invention.

FIG. 3 illustrates a schematic diagram of the manner in which liquid, e.g., plating solution, may be delivered during the recirculation step in accordance with one or more embodiments of the invention. At the recirculation step, liquid, e.g., plating solution, flows from the sampling reservoir 160 through open valve 290 to the pump 180. The plating solution then flows through open valve 285 to the chemical analyzer 150 and back to the sampling reservoir 160. Valves 205, 210, 220, 230, 240, 250, 260, 270 and 280 are closed. The chemical analyzer 150 may measure the chemical concentrations of the plating solution during this recirculation step, which may be repeated any number of times.

Figure 4:
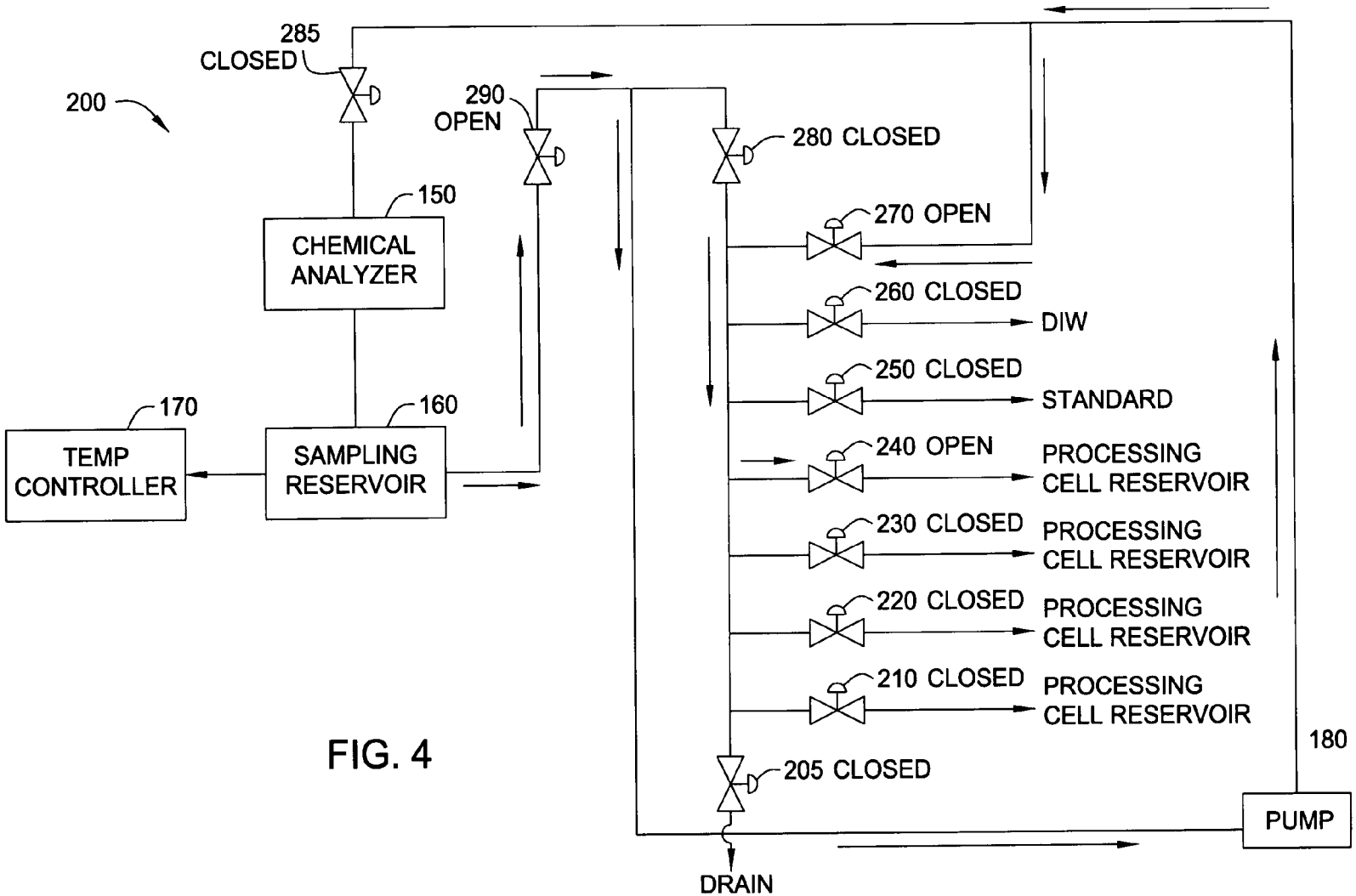
FIG. 4 illustrates the flow of the plating solution from the sampling reservoir to the respective plating cell reservoir in accordance with one or more embodiments of the invention.

Once the chemical analyzer 150 has completed measuring the chemical concentrations of the plating solution in the sampling reservoir 160, the plating solution may be returned to the respective plating cell reservoir from which it comes. FIG. 4 illustrates the flow of the plating solution from the sampling reservoir 160 to the respective plating cell reservoir in accordance with one or more embodiments of the invention. The plating solution flows from the sampling reservoir 160 through open valve 290 to the pump 180. The plating solution then flows out of the pump 180 through open valve 270 and open valve 240 to the respective plating reservoir from which the plating solution comes. Valves 205, 210, 220, 230, 250, 260, 280 and 285 are closed. The plating solution may also be drained out of the plumbing system 200 upon completion of the chemical concentrations measurement by the chemical analyzer 150. The manner in which liquid may be drained out of the plumbing system is described in detail with reference to FIG. 5.

Figure 5:
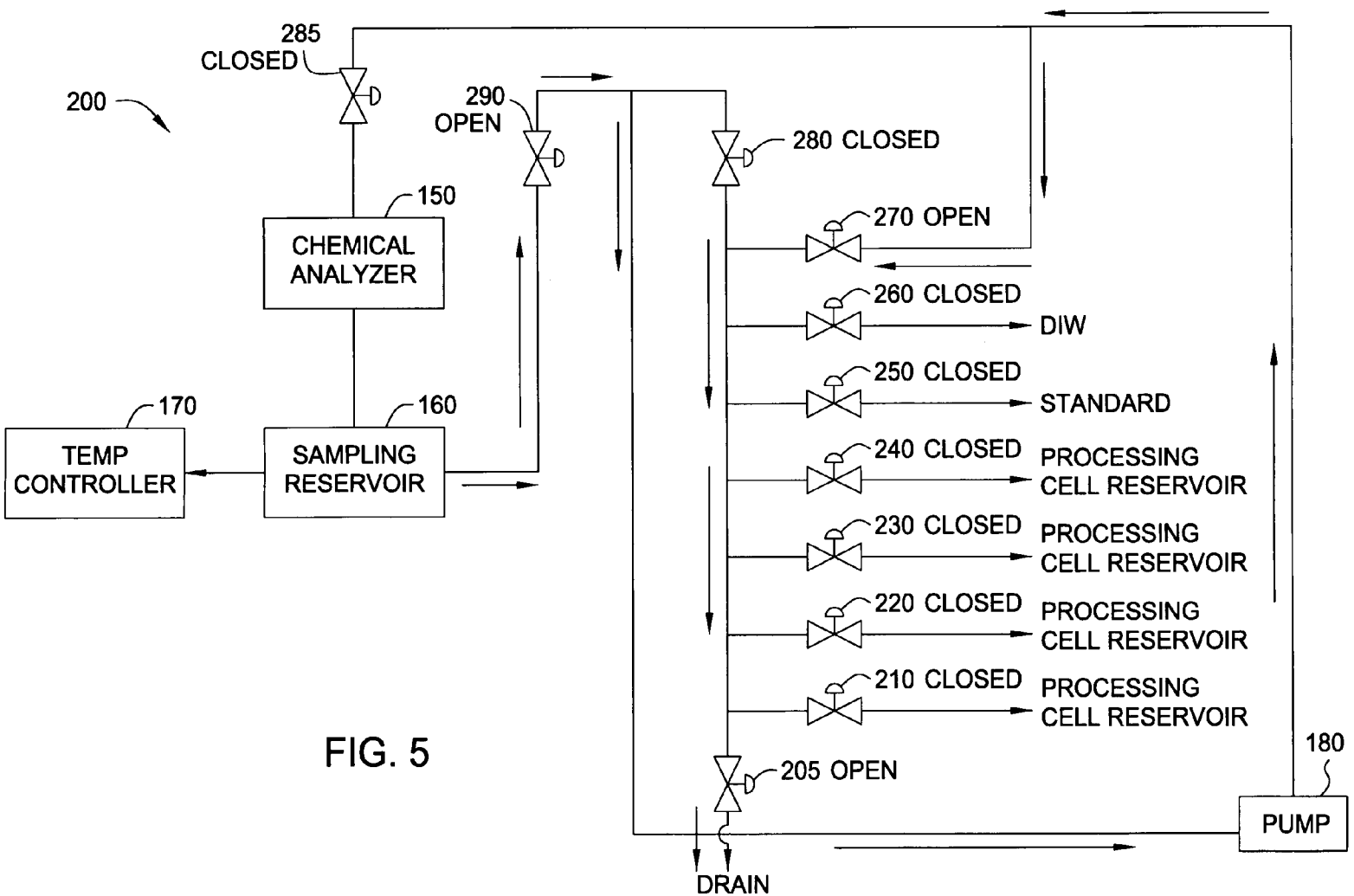
FIG. 5 illustrates the flow of liquid, e.g., de-ionized water or standard solution, out of the plumbing system in accordance with on one or more embodiments of the invention.

In situations in which de-ionized water may be circulated through the plumbing system 200 or the chemical analyzer 150 may be calibrated with standard solution, the liquid may be drained out of the plumbing system 200 upon completion of the circulation of the de-ionized water or standard solution. FIG. 5 illustrates the flow of liquid, e.g., de-ionized water or standard solution, out of the plumbing system 200 in accordance with one or more embodiments of the invention. The liquid flows from the sampling reservoir 160 through open valve 290 to the pump 180. The liquid then flows out of the pump 180 through open valve 270 and open valve 205 out of the plumbing system 200. Valves 210, 220, 230, 240, 250, 260, 280 and 285 are closed.

While the foregoing is directed to embodiments of the present invention, other and further embodiments of the invention may be devised without departing from the basic scope thereof, and the scope thereof is determined by the claims that follow.

What is claimed is:

1. An electrochemical plating system, comprising:

one or more plating cell reservoirs for storing plating solution;

a chemical analyzer in fluidic communication with the one or more plating cell reservoirs, wherein the chemical analyzer is configured to measure chemical concentrations of the plating solution;

a sampling reservoir coupled to the chemical analyzer, wherein the sampling reservoir is configured to hold a portion of the plating solution;

a plumbing system configured to facilitate the fluidic communication between the one or more plating cell reservoirs and the chemical analyzer and to substantially isolate the chemical analyzer from electrical noise generated by one or more plating cells of the one or more plating cell reservoirs, wherein the plumbing system comprises at least one valve that allows the portion of the plating solution to flow from the one or more plating cell reservoirs to the sampling reservoir, when the at least one valve is in an open position; and a system controller, wherein the system controller comprises a microprocessor, and wherein the system controller is configured to receive inputs and use the inputs to control:

(i) circulating a portion of a plating solution through the chemical analyzer; and (ii) switching the at least one valve to a closed position once the sampling reservoir is filled with the portion of the plating solution to substantially isolate the chemical analyzer from the electrical noise generated by the one or more plating cells.

2. The system of claim 1, wherein the plumbing system comprises a first flow path for delivering the portion of the plating solution from the one or more plating cell reservoirs to the sampling reservoir.

3. The system of claim 1, wherein the plumbing system comprises a second flow path for circulating the portion of the plating solution through the chemical analyzer.

4. The system of claim 1, wherein the plumbing system comprises a third flow path for returning the portion of the plating solution to the one or more plating cell reservoirs.

5. The system of claim 4, wherein the system controller further controls using the third flow path following the completion of the measurement of chemical concentrations in the portion of the plating solution.

6. The system of claim 1, wherein the plumbing system comprises a fourth flow path for draining liquid from the sampling reservoir out of the plumbing system.

7. The system of claim 6, wherein the system controller further controls using the fourth flow path for discarding one of de-ionized water and standard solution.

8. The system of claim 1, further comprising a temperature controller for maintaining the temperature of liquid inside the sampling reservoir within a predetermined range.

9. The system of claim 8, wherein the predetermined range is from about 18 degrees Celsius to about 22 degrees Celsius.

10. The system of claim 1, further comprising a temperature controller for maintaining the temperature of liquid inside the sampling reservoir at about 20 degrees Celsius.

11. The system of claim 1, wherein the electrical noise is generated by application of voltage in the one or more plating cells.

12. The plumbing system of claim 1, wherein the plumbing system comprises one or more bi-directional flow paths between the one or more plating cell reservoirs and the chemical analyzer.

13. An electrochemical plating system, comprising:

one or more plating cell reservoirs for storing plating solution;

a chemical analyzer in fluidic communication with the one or more plating cell reservoirs, wherein the chemical analyzer is configured to measure chemical concentrations of the plating solution;

a sampling reservoir coupled to the chemical analyzer, wherein the sampling reservoir is configured to hold a portion of the plating solution;

a plumbing system configured to facilitate the fluidic communication between the one or more plating cell reservoirs and the chemical analyzer and to substantially isolate the chemical analyzer from electrical noise generated by one or more plating cells of the one or more plating cell reservoirs, wherein the plumbing system comprises:

(i) at least one valve that allows the portion of the plating solution to flow from the one or more plating cell reservoirs to the sampling reservoir, when the at least one valve is in an open position;

(ii) a first flow path for delivering the portion of the plating solution from the one or more plating cell reservoirs to the sampling reservoir;

(iii) a second flow path for circulating the portion of the plating solution through the chemical analyzer;

(iv) a third flow path for returning the portion of the plating solution to the one or more plating cell reservoirs; and (v) a fourth flow path for draining liquid from the sampling reservoir out of the plumbing system; and a system controller, wherein the system controller comprises a microprocessor, and wherein the system controller is configured to receive inputs and use the inputs to control:

(i) circulating a portion of a plating solution through the chemical analyzer; and (ii) switching the at least one valve to a closed position once the sampling reservoir is filled with the portion of the plating solution to substantially isolate the chemical analyzer from the electrical noise generated by the one or more plating cells.

* * * * *